US008667933B2

(12) United States Patent
Grether et al.

(10) Patent No.: US 8,667,933 B2
(45) Date of Patent: Mar. 11, 2014

(54) TWO-STROKE ENGINE

(75) Inventors: Michael Grether, Waiblingen (DE); Robert Köhli, Winnenden (DE); Stefan Kummermehr, Berglen (DE)

(73) Assignee: Andreas Stihl AG & Co. KG, Waiblngen (DE)

( * ) Notice: Subject to any disclaimer, the term of this patent is extended or adjusted under 35 U.S.C. 154(b) by 258 days.

(21) Appl. No.: 13/327,054

(22) Filed: Dec. 15, 2011

(65) Prior Publication Data

US 2012/0152218 A1 Jun. 21, 2012

(30) Foreign Application Priority Data

Dec. 16, 2010 (DE) ..... 10 2010 054 838

(51) Int. Cl.

| | |
|---|---|
| ***F02B 33/04*** | (2006.01) |
| ***F02B 25/22*** | (2006.01) |
| ***F02B 25/14*** | (2006.01) |
| *F02B 25/00* | (2006.01) |

(52) U.S. Cl.

CPC ..... *F02B 25/22* (2013.01); *F02B 25/00* (2013.01); *F02B 25/14* (2013.01)

USPC ..... 123/73 PP; 123/73 A; 123/184.23

(58) Field of Classification Search

USPC ..... 123/73 A, 73 PP, 65 A, 184.21, 184.23

See application file for complete search history.

(56) References Cited

U.S. PATENT DOCUMENTS 7,513,225 B2 4/2009 Geyer et al.

FOREIGN PATENT DOCUMENTS

DE 10 2007 037 009 A1 3/2008

*Primary Examiner* — Noah Kamen

(74) *Attorney, Agent, or Firm* — Paul D. Strain, Esq.; Strain & Strain PLLC

(57) ABSTRACT

A two-stroke engine, comprising: a crankcase; a cylinder connected to said crankcase; a combustion chamber defined by a reciprocally mounted piston within said cylinder; a crankshaft mounted rotatably in said crankcase and drivingly connected with said piston; at least one overflow passage connecting the crankcase and the combustion chamber when the piston is positioned in the lower dead center region; a connecting stub attached to said cylinder which contains an intake passage that opens into the crankcase and supplies fuel and combustion air, said intake passage including therein an air-fuel mixture passage, wherein said connecting stub contains at least one section of the mixture passage; at least one fuel opening for supplying fuel into said mixture passage; and a guiding rib positioned within said connecting stub and oriented longitudinally in the mixture passage and protruding into the mixture passage.

13 Claims, 4 Drawing Sheets

TWO-STROKE ENGINE

CROSS-REFERENCE TO RELATED PATENT APPLICATIONS

This application is based upon and claims the benefit of priority from prior German Patent Application No. 10 2010 054 838.3, filed Dec. 16, 2010 the entire contents of which are incorporated herein by reference in their entirety.

BACKGROUND

The invention relates to a two-stroke engine of the type having a cylinder, in which a combustion chamber is formed, wherein the combustion chamber is bounded by a piston which drives a crankshaft mounted rotatably in a crankcase, wherein the crankcase is connected, via at least one overflow passage, to the combustion chamber when the piston is in the region of its lower dead center, with an air-fuel mixture passage which opens into the crankcase and which is guided in an intake passage, for supplying fuel and combustion air and into which fuel is supplied via at least one fuel opening, and wherein at least one section of the mixture passage is guided in a connecting stub.

DE 10 2007 037 009 A1 discloses a connecting stub for a two-stroke engine, the intake passage of which is divided into an air passage and a mixture passage.

It has been shown that, in particular during idling, the running behavior in a two-stroke engine of this type may be inadequate because fuel can accumulate in the connecting stub and is then supplied to the crankcase in an undefined manner. Dead regions in the connecting stub, in which there is insufficient flow of air, may also cause fuel to accumulate, the fuel then not being available to the internal combustion engine.

It is known to provide the connecting stub with grooves which conduct the fuel accumulated in the connecting stub away to the crankcase. Structures, in which fuel can accumulate, such as pyramid-shaped elevations or ribs running in the circumferential direction, are also known.

SUMMARY OF THE INVENTION

It is one object of the invention to provide a two-stroke engine of the type discussed above, which has improved running behavior, even during idling.

This and other objects are achieved by a two-stroke engine, comprising: a crankcase; a cylinder connected to the crankcase; a piston reciprocally mounted within the cylinder to define a combustion chamber in the cylinder; a crankshaft mounted rotatably in the crankcase and drivingly connected with the piston; at least one overflow passage connecting the crankcase and the combustion chamber when the piston is located in the region of its lower dead center position; a connecting stub attached to the cylinder and having therein an intake passage that opens into the crankcase and supplies fuel and combustion air, this intake passage including therein an air-fuel mixture passage, wherein at least one section of the mixture passage extends in the connecting stub; at least one fuel opening for supplying fuel into the mixture passage; and a guiding rib positioned within the connecting stub and running in the longitudinal direction of the mixture passage and protruding into the mixture passage. Further objects, features and advantages of the present invention will become apparent from the detailed description of preferred embodiments of the invention which is set forth below, when considered together with the figures of drawing.

BRIEF DESCRIPTION OF THE DRAWINGS

An exemplary embodiment of the invention is explained below with reference to the drawings, in which.

DETAILED DESCRIPTION OF PREFERRED EMBODIMENTS

Figure 1:
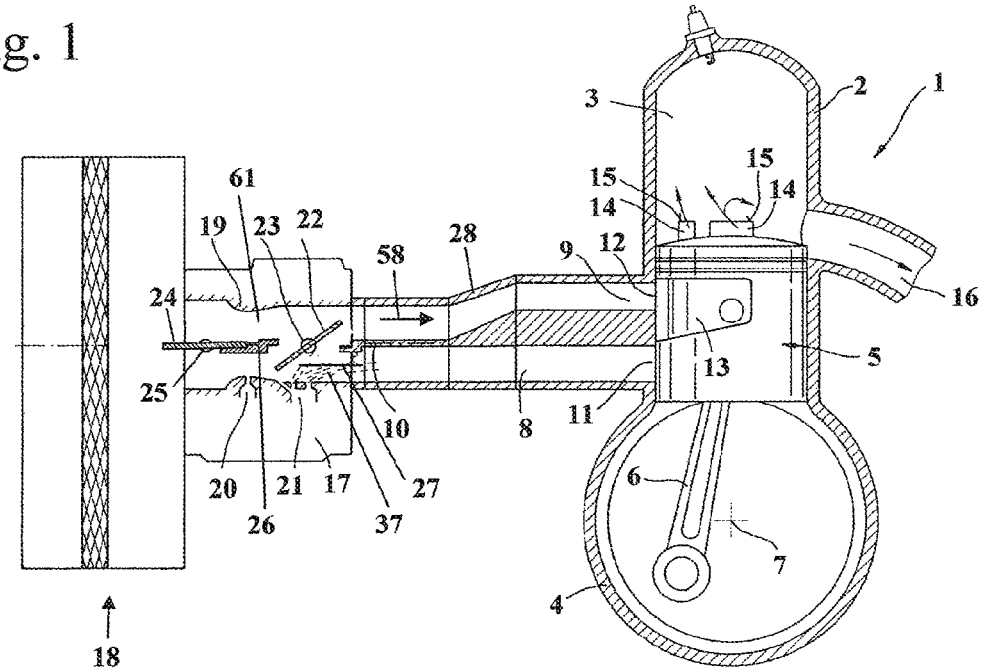
FIG. 1 shows a schematic sectional illustration of a two-stroke engine.

It has surprisingly been shown that the formation of regions of turbulence and dead regions in the connecting stub can be substantially prevented by a guiding rib which runs in the longitudinal direction of the mixture passage and protrudes into the mixture passage. A uniform flow in the mixture passage is thereby achieved in a simple manner. This is advantageous, in particular, in two-stroke engines in which, during idling, there is low flow through the mixture passage, for example, in the case of two-stroke engines in which the intake passage is separated into an air passage and a mixture passage which are controlled by a common throttle element. By means of the guiding rib, a local accumulation of the wall film forming in the connecting stub can be largely avoided, even when there is low air flow. The guiding rib is advantageously arranged in such a manner that fuel is deposited in the form of a wall film essentially only on one longitudinal side of the guiding rib. The guiding rib prevents the wall film from spreading out over the entire circumference of the mixture passage.

The height of the guiding rib is advantageously small with reference to the diameter of the intake passage. A height of the guiding rib of approximately 5% to approximately 25% of the diameter of the intake passage at the upstream end of the connecting stub has proven advantageous. In particular, the height of the guiding rib is preferably approximately 10% to approximately 20% of the diameter of the intake passage at the upstream end of the connecting stub.

For thorough mixture preparation, it is provided, according to another aspect of the invention, that a secondary passage into which at least one idling fuel opening opens is formed in the mixture passage. In this case, the secondary passage advantageously opens laterally into the mixture passage in a manner offset in the circumferential direction with respect to the guiding rib by an angle about the longitudinal axis of the intake passage with reference to the direction of flow in the connecting stub. This ensures that fuel flows essentially along only one side of the guiding rib. Despite the comparatively low height of the guiding rib, it is possible largely to prevent fuel from being deposited in the form of a wall film on the connecting stub on that side of the guiding rib which faces away from the secondary passage. The angle here is advantageously selected in such a manner that there is a distance between the secondary passage and guiding rib, as seen in the direction of flow. The distance here can be small and can be considerably less than the width of the secondary passage. In this case, the secondary passage is advantageously partially bounded by the outer wall of the connecting stub, and therefore the fuel/air mixture leads from the secondary passage into the connecting stub close to the wall. The guiding rib is advantageously at a distance from the upstream end of the connecting stub, which distance approximately corresponds to the length of that section of the secondary passage which is guided in the connecting stub. The guiding rib is not required in those regions of the mixture passage in which fuel does not flow during idling, and therefore the guiding rib begins only at the exit from the secondary passage.

A section of the intake passage is advantageously formed in a carburetor. Downstream of the carburetor, the intake passage is divided in particular into an air passage and the mixture passage. The air passage here is advantageously connected to at least one overflow passage and serves to feed advance scavenging air into the overflow passages. At least one fuel opening in the carburetor opens into the intake passage. A throttle element, in particular a throttle valve, is mounted pivotably in the carburetor, said throttle valve controlling the combustion air quantity supplied to the air passage and the mixture passage. In particular in the case of two-stroke engines, in which the intake passage is divided into an air passage and a mixture passage, the flow through the mixture passage is very small during idling, since the air passage is also partially opened by the throttle element on account of the joint control of both passages. For two-stroke engines of this type, the arrangement of a guiding rib has proven particularly advantageous.

The guiding rib on the outer wall of the mixture passage is advantageously arranged lying opposite a separating wall separating an air passage and mixture passage and divides the outer wall into a first circumferential section and a second circumferential section. In this case, the secondary passage advantageously opens into one of the two circumferential sections. In particular, the secondary passage opens into the larger of the two circumferential sections.

In order to improve the temporary storage of fuel in the connecting stub, which is deposited in the form of a wall film, the connecting stub is provided with pyramid-shaped elevations in the mixture passage. Pyramid-shaped elevations are preferably also provided in the air passage, since, in particular during idling, fuel may also overflow into the air passage. The elevations are advantageously oriented and offset with respect to one another in such a manner that intersecting passages which are inclined with respect to the longitudinal axis of the intake passage are formed between the elevations. Elevations in the connecting stub are advantageously arranged on the entire radially outer, inner wall surface of the intake passage, i.e., inside surfaces located on the outer wall of the mixture passage and on the outer wall of the air passage, and also on both sides of the separating wall. The elevations therefore advantageously extend substantially over the entire inner circumference of the mixture passage and air passage. The elevations in the air passage advantageously extend over less than half of the length of the air passage guided in the connecting stub, in particular over less than one third of the length of the air passage in the connecting stub. The elevations in the mixture passage advantageously extend over less than half, in particular over less than one third of the length of the mixture passage guided in the connecting stub. Owing to the fact that the elevations extend only over a subsection of the length of the connecting stub, the durability of the elastic connecting stub during operation is increased. In this case, the elevations are arranged in particular in a central region of the connecting stub. The elevations in the air passage and the elevations in the mixture passage are advantageously arranged axially offset with respect to one another in the direction of flow. This also increases the durability of the elastic connecting stub during operation.

The mixture passage expediently has different cross-sectional shapes at the upstream end and at the downstream end of the connecting stub.

Turning now to the drawings, FIG. 1 schematically shows a two-stroke engine 1, as can be used, for example, for driving a tool in hand-guided working implements, such as motor-driven saws, abrasive cutting-off machines, brush cutters or the like. The two-stroke engine 1 has a cylinder 2, in which a combustion chamber 3 is formed. The combustion chamber 3 is bounded on one side by a piston 5 which is mounted such that it moves to and fro in the cylinder 2 and, via a connecting rod 6, drives a crankshaft 7, which is mounted rotatably in a crankcase 4. In the lower dead center of the piston 5, the interior of the crankcase 4 is connected to the combustion chamber 3 via overflow passages 14 which open by means of overflow apertures 15 into the combustion chamber 3. An outlet 16 for exhaust leads out of the combustion chamber 3. The two-stroke engine 1 has an intake passage 61 which is connected to an air filter 18 and via which combustion air is sucked in. A section of the intake passage 61 is formed in carburetor 17. A choke valve 24 with a choke shaft 25, and also, downstream of the choke valve 24, a throttle valve 22 with a throttle shaft 23 is mounted pivotably in the carburetor 17, which is designed in the exemplary embodiment as a diaphragm-type carburetor. Instead of the throttle valve 22, a different throttle element may alternatively be provided, and instead of the choke valve 24, a different choke element may alternatively be provided. Downstream of the throttle valve 22, the intake passage 61 is separated by a separating wall 10 into an air-fuel mixture passage 8 and an air passage 9. A separating wall section 26 is arranged between the throttle valve 22 and choke valve 24. A main fuel opening 20 and a plurality of idling fuel openings 21 in the carburetor 17 open into the mixture passage 8. The idling fuel openings 21 open into the mixture passage 8 downstream of the main fuel opening 20. In the region of the main fuel opening 20, a Venturi 19 is formed in the intake passage 61.

The mixture passage 8 opens with a mixture inlet 11 on the cylinder 2 and the port is controlled by the piston 5. The air passage 9 opens with an air inlet 12 on the cylinder 2. The piston 5 has one or more piston recesses 13 which connect the air inlet 12 in the region of the upper dead center of the piston 5 to the overflow apertures 15. The air passage 9 may alternatively be divided into two branches which each open with a separate air inlet 12 on the cylinder 2.

During operation, a fuel/air mixture is sucked up into the crankcase 4 via the mixture inlet 11 during the upward stroke of the piston 5. In the region of the upper dead center, largely fuel-free combustion air from the air passage 9 is temporarily stored in the overflow passages 14. During the downward stroke of the piston 5, the fuel/air mixture in the crankcase 4 is compressed and enters the combustion chamber 3 in the region of the lower dead center of the piston 5. In the process, the air temporarily stored in the overflow passages 14 first of all flows into the combustion chamber 3. During the subsequent upward stroke of the piston 5, the fuel/air mixture is once again compressed in the combustion chamber 3 and ignited in the region of the upper dead center of the piston 5. During the subsequent downward stroke of the piston 5, the outlet 16 is opened, and the exhaust gases flow out of the combustion chamber 3 and are expelled by the combustion air flowing in subsequently via the overflow passages 14.

The combustion air flows in the intake passage 61 in a direction of flow 58 from the air filter 18 to the cylinder 2. A connecting stub 28 is arranged between the carburetor 17 and cylinder 2, the connecting stub being composed of an elastic material, for example, rubber or an elastomeric plastic, and in which both the mixture passage 8 and the air passage 9 are guided. A shielding element 27 which bounds a secondary passage 37 is arranged in the mixture passage 8, adjacent to the throttle valve 22. At least one idling fuel opening 21 opens into the secondary passage 37. The secondary passage 37 is arranged in the mixture passage 8 and is separated from the latter by the shielding element 27.

Figure 2:
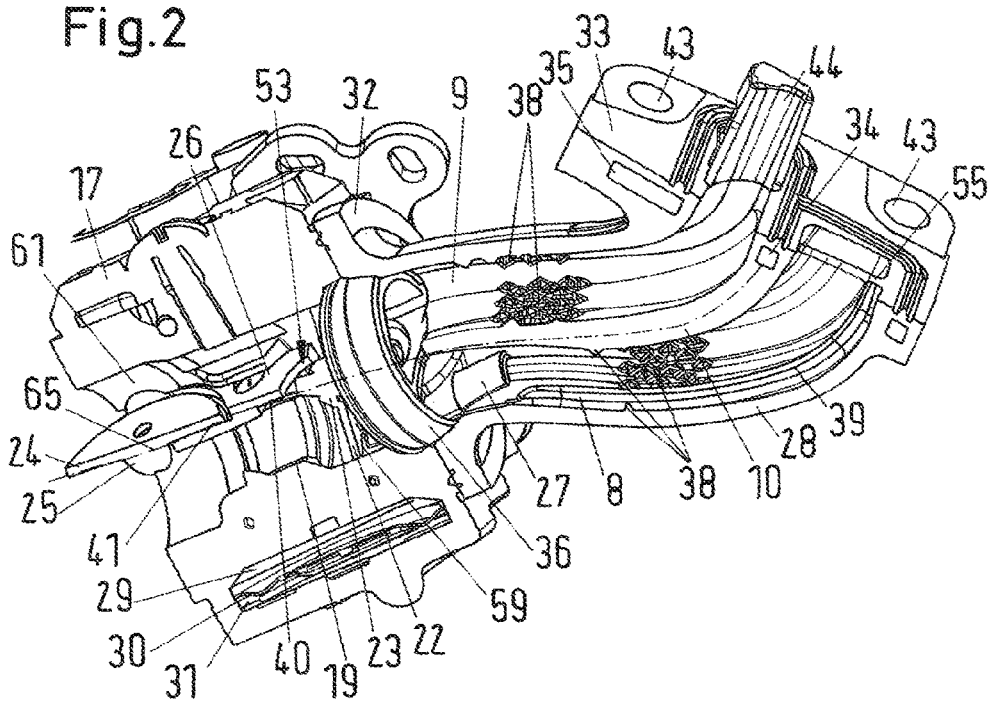
FIG. 2 shows a perspective sectional illustration through a carburetor and connecting stub of the two-stroke engine from FIG. 1.

FIG. 2 shows the configuration in detail. An intermediate ring 36 is arranged between the carburetor 17 and connecting stub 28, said intermediate ring being held in a sealing manner in both the carburetor 17 and in the connecting stub 28. The shielding element 27 is preferably integrally formed on the intermediate ring 36. The intermediate ring 36 is advantageously composed of a dimensionally stable plastic.

As FIG. 2 shows, the carburetor 17 preferably has a control chamber 29 which is separated from a compensation chamber 31 via a diaphragm 30. The fuel is metered to the intake passage 61 via the control chamber 29. As FIG. 2 also shows, the separating wall section 26 has a cutout or recess 41 on the side facing the air passage 9, against which the choke valve 24 bears. In the completely open position, the choke valve 24 preferably adjoins the separating wall section 26 in an approximately flush manner. The separating wall section 26 extends upstream, preferably nearly as far as the choke shaft 25. The separating wall section 26 is at a distance from the throttle shaft 23. On the side facing the mixture passage 8, the separating wall section 26 has a cutout or recess 40 which is formed on a narrow border of the separating wall section 26 and against which the throttle valve 22 bears in the fully open position. An opening 53 is formed between the separating wall section 26 and the throttle shaft 23, via which opening the air passage 9 and the mixture passage 8 are connected to each other in the closed and partially open position of the throttle valve 22.

The throttle valve 22 has an opening 59, the border of which, in the closed position of the throttle valve 22, is arranged on the shielding element 27 in an approximately flush manner such that combustion air from the region upstream of the throttle valve 22 can enter the secondary passage 37 through the opening 59. As FIG. 2 also shows, the shielding element protrudes both into the carburetor 17 and into the connecting stub 28.

As FIG. 2 shows, the intake passage 61 is separated in the connecting stub 28 by the separating wall 10 into an air passage 9 and mixture passage 8. Both in the air passage 9 and in the mixture passage 8, elevations 38 which are of approximately pyramid-shaped design and at which precipitated fuel can accumulate are arranged in a central region of the connecting stub 8. The fuel is gradually output again by the elevations 38 to the combustion air flowing past, thus avoiding a surge-like overflowing of fuel, for example if the two-stroke engine 1 is pivoted. The elevations in the air passage 9 are arranged upstream of the elevations in the mixture passage 8. The elevations 38 in the air passage 9 and in the mixture passage 8 do not overlap in the direction of flow 58, and therefore in each cross section located perpendicularly to the longitudinal center axis 65, elevations 38 are provided in the mixture passage 8 or in the air passage 9, or no elevations 38 are provided, i.e., elevations 38 are not provided both in the air passage 9 and in the mixture passage 8 in any cross section.

As FIG. 2 also shows, a guiding rib 39 which runs approximately in the direction of the longitudinal axis 65 of the intake passage is arranged in the mixture passage 8 on the passage side opposite the separating wall 10. In FIGS. 1 and 2, the mixture passage 8 is arranged below the air passage 9. However, in the actual installed position, the mixture passage 8 is advantageously arranged above the air passage 9 with reference to the direction of gravitational force.

The connecting stub 28 has a carburetor connection flange 32, by which said connecting stub is held on the carburetor 17. The carburetor connection flange 32 is held on the end side of the carburetor 17 via clamping elements (not shown). For connection to the cylinder 2, the connecting stub 28 has an engine connection flange 33. The engine connection flange 33 has fastening openings 43 for fastening means, for example, bolts, with which the engine connection flange 33 can be screwed to the cylinder flange. In order to increase the strength, the engine connection flange 33 has a reinforcing element 35 which is injected into the material of the connecting stub 28. An encircling seal 34, which completely surrounds the mouth openings of the air passage 9 and mixture passage 8 and thus results in good sealing, is injected onto the end side. Two stubs or short feed pipes 44, of which one is shown in the sectional illustration in FIG. 2, are preferably integrally formed on the connecting stub 28. The stubs 44 protrude beyond the engine connection flange 33 into the cylinder flange and bound the air passage 9. This results in a favorable shaping, and the cylinder flange can easily be removed from the mold during the production of the cylinder 2 by die-casting.

Figure 3:
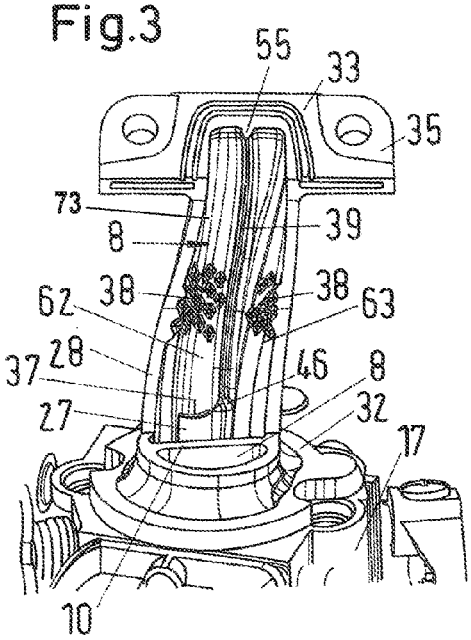
FIG. 3 shows a partially sectioned, perspective illustration of the connecting stub from FIG. 2, FIG. 4 and FIG. 5 show side views of the connecting stub.

As FIG. 3 shows, the guiding rib 39 has an upstream, carburetor-side end 46 which is offset from the carburetor connection flange 32 into the interior of the connecting stub 28. In addition, the guiding rib 39 has a downstream, engine-side end 55 which lies in the plane of the engine connection flange 33. The carburetor-side end 46 lies approximately at the height of the end of the shielding element 27.

The guiding rib 39 divides the outer wall 73 of the mixture passage 8 (FIG. 7) into a first circumferential section 62 and a second circumferential section 63. The shielding element 27 is offset in the circumferential direction in relation to the guiding rib 39, and therefore the secondary passage 37 opens at the first circumferential section 62. The guiding rib 39 serves to guide the flow toward the cylinder 2 in the direction of the longitudinal axis 65 of the intake passage. At the same time, the wall film of fuel precipitated in the first circumferential section 62 is prevented from migrating into the second circumferential section 63. This is advantageous, in particular during idling. The fuel and the combustion air are guided directly to the cylinder 2 by the guiding rib 39. This prevents the fuel from being distributed throughout the entire connecting stub 28. As a result, fuel cannot pass into dead regions not having an air flow, and therefore an accumulation of fuel and an undefined, surge-like introduction of fuel into the crankcase 4 are avoided. In addition, the guiding rib 39 projecting into the mixture passage 8 evens out the flow in the mixture passage 8 and prevents turbulence in the flow.

Figure 4:
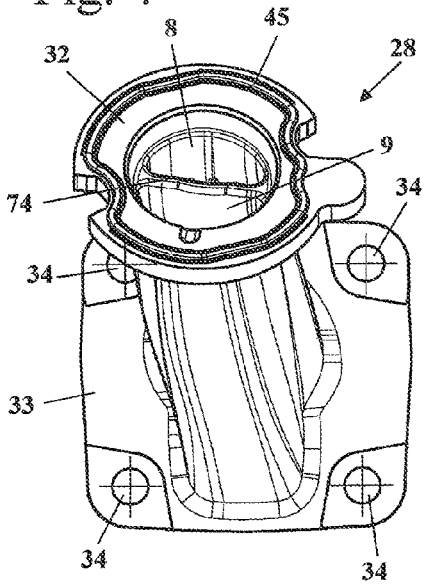

As FIG. 4 shows, a seal 45 which is integrally formed on the connecting stub 28 is provided on the carburetor connection flange 32.

Figure 5:
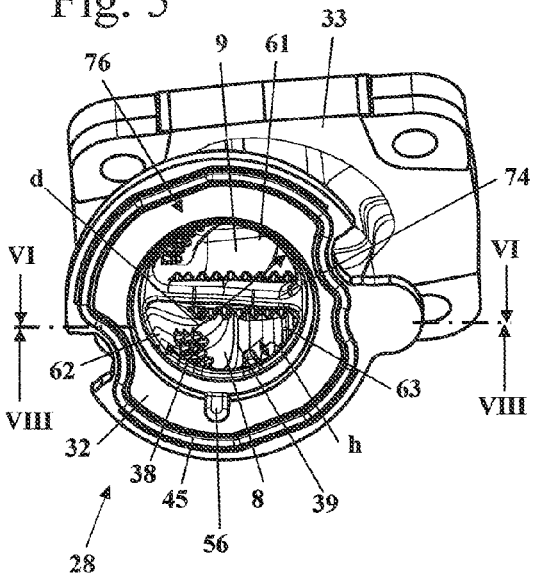

FIG. 5 shows the arrangement of the elevations 38. As FIG. 5 shows, elevations 38 are provided both in the air passage 9 and in the mixture passage 8. The separating wall is formed in the connecting stub 28 by a separating wall section 74, which is formed integrally on the connecting stub 28. Elevations 38 are also arranged on both sides of the separating wall section 74.

As FIG. 5 shows, the intake passage 61 on the carburetor connection flange 32 has a diameter d. The diameter d is therefore measured at the carburetor-side end 76 of the connecting stub 28. The height h of the guiding rib 39 is significantly smaller than the diameter d of the intake passage 61. The height h is advantageously approximately 5% to approximately 25%, in particular approximately 15% to approximately 20% of the diameter d of the intake passage 61. On the carburetor connection flange 32, the connecting stub 28 has a receptacle or notch 56 into which an element for positionally securing the intermediate ring 36 protrudes.

Figure 6:
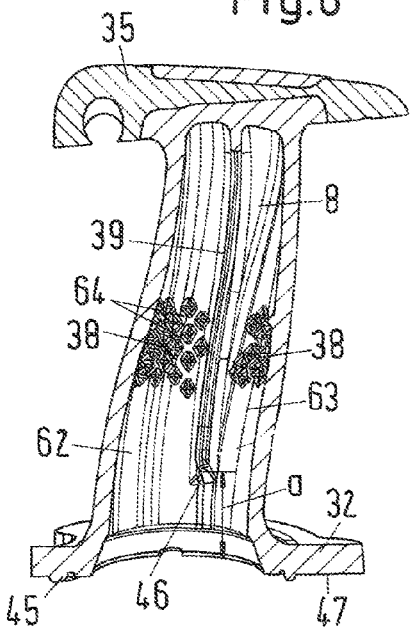
FIG. 6 shows a section through the connecting stub along the line VI-VI in FIG. 5.
Figure 8:
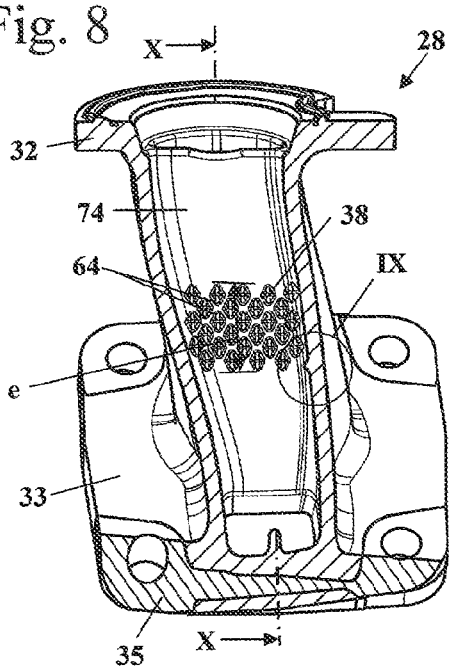
FIG. 8 shows a section along the line VIII-VIII in FIG. 7.

FIG. 6 shows the configuration of the guiding rib 39 and the arrangement of the elevations 38. The carburetor-side end of the guiding rib 39 is at a distance a from the connection surface 47 of the carburetor connection flange 32. The elevations 38 are arranged in such a manner that passages which each run at an inclination with respect to the longitudinal axis 65 of the intake passage (FIG. 2) and which intersect are formed between the pyramid-shaped elevations 38. As a result, the accumulated fuel can be readily and uniformly conducted away to the combustion air flowing past. At the same time, a relatively large quantity of fuel can be picked up and temporarily stored. The passages 64 are also shown in FIG. 8.

Figure 7:
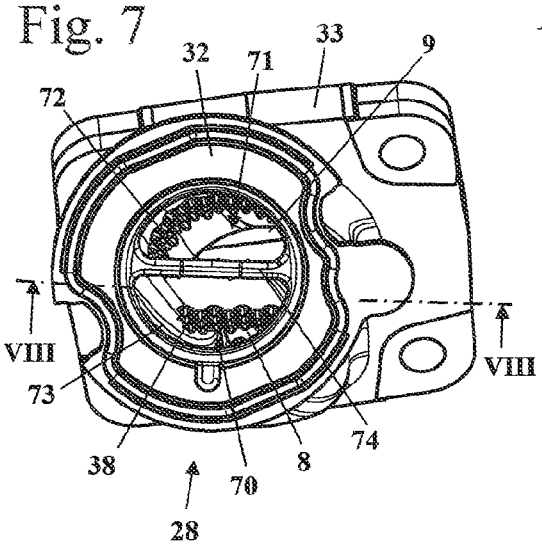
FIG. 7 shows a side view of the connecting stub.
Figure 10:
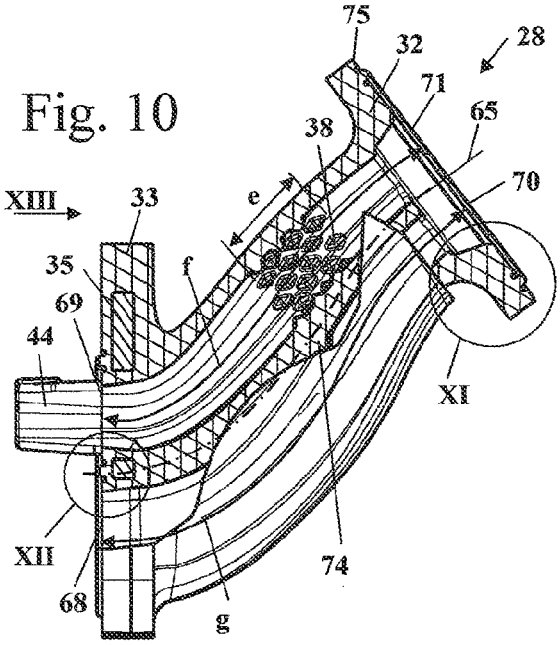
FIG. 10 shows a partially sectioned view along the line X-X in FIG. 8.

As FIG. 7 shows, the connecting stub 28 on the carburetor connection flange 32 has an entry opening 70 into the mixture passage 8 and an entry opening 71 into the air passage 9. Both entry openings 70, 71 have an approximately semicircular cross section. The entire intake passage 61 has a round cross section which is divided by a separating wall section 74 into the two semicircular entry openings 70 and 71. The mixture passage 8 has an outer wall 73 which is bounded by a curved wall section of the intake passage 61 and on which elevations are arranged. Elevations 38 are also provided on the curved outer wall 72 of the air passage 9. (See also FIG. 5) As FIG. 8 shows, elevations 38 are also provided on the separating wall section 74, on the side facing the mixture passage 8. Elevations 38 are also arranged on the separating wall section 74, on the opposite side facing the air passage 9. As FIG. 8 shows, the elevations 38 extend over a length e of the mixture passage 8, which length is significantly smaller than that length *g* of the mixture passage 8 which is shown in FIG. 10. The length *e* is advantageously less than a half, in particular less than a third, of the length *g*.

As FIG. 10 also shows, elevations 38 which extend over a length *e'*, which is measured in the direction of the longitudinal axis 65 of the intake passage, are arranged in the air passage 9. The length *e'* of the elevations 38 in the air passage 9 is advantageously less than half of the length *f* of the air passage 9, in particular less than one third of the length *f*. In this case, the lengths measured in the air passage 9 and mixture passage 8 are average lengths which are advantageously measured at the connecting line of the centers of the cross-sectional areas of the particular passage.

Figure 9:
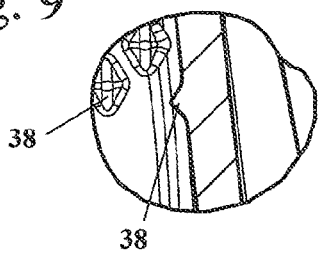
FIG. 9 shows the detail IX from FIG. 8 in an enlarged illustration.

As FIG. 9 shows, the elevations 38 are of pyramid-shaped design and have a triangular cross section. In this case, the side edges of the pyramid-shaped elevations 38 are arranged in a diamond-shaped manner on the passage wall. The intersecting passages 64 are formed by the side walls which are inclined with respect to the longitudinal axis 65 of the intake passage (FIG. 8).

Figure 11:
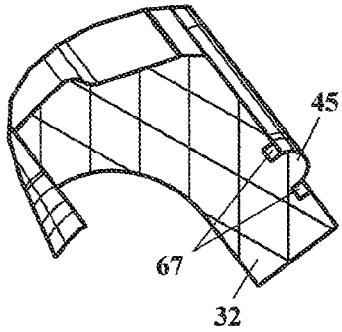
FIG. 11 shows the detail XI from FIG. 10.

Respective seals 45 and 34, which surround the mouth openings at the respective connection surface, are arranged on the connection flanges 32 and 33. As FIGS. 10 and 11 show, the seal 45 which consists of the material of the connecting stub 28 and is integrally injection-molded on the connecting stub is arranged on the carburetor connection flange 32. Grooves 67 which surround the seal 45 and permit good contact pressure and lateral yielding of the seal 45 are provided on both sides of the seal 45. The seal 45 jointly surrounds both entry openings 70 and 71. The separating wall 74 does not begin until shortly after the connection surface 75 of the carburetor connection flange 32.

Figure 12:
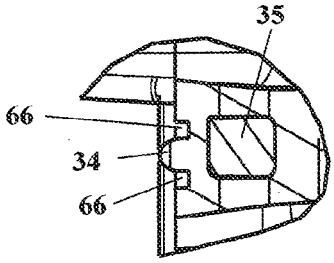
FIG. 12 shows the detail XII from FIG. 10.

As FIG. 12 shows, the seal 34 on the engine connection flange 33 is surrounded by grooves 66. The seal 34 surrounds the mouth openings 68 and 69, which are shown in FIG. 10, of the mixture passage 8 and air passage 9, individually, such that the mouth openings 68 and 69 are separated from each other by the seal 34.

Figure 13:
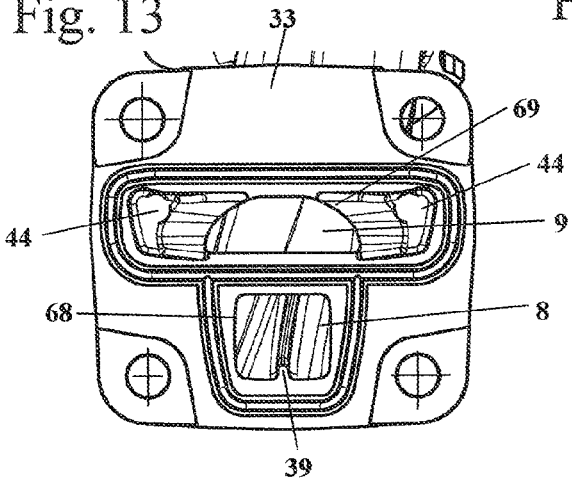
FIG. 13 shows a side view in the direction of the arrow XIII in FIG. 10.
Figure 14:
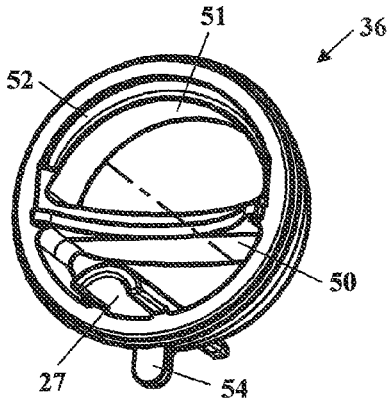
FIG. 14 shows a perspective illustration of an intermediate ring.
Figure 15:
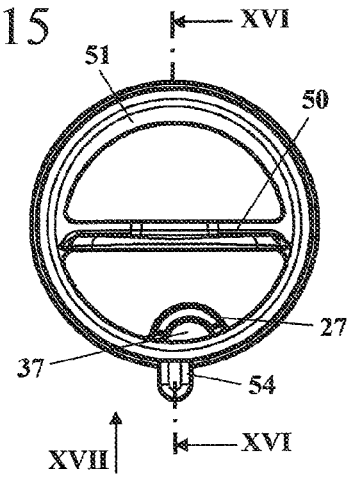
FIG. 15 shows a side view of the intermediate ring from the side facing the connecting stub.

This is also shown in FIG. 13. As FIG. 13 also shows, the mouth opening 69 of the air passage 9 has an approximately semicircular flow cross section which corresponds approximately to the cross section at the entry opening 71. The shape of the flow cross section of the mouth opening 68 of the mixture passage 8 is approximately rectangular, wherein the guiding rib 39 protrudes into the rectangular cross section. The mixture passage 8 accordingly has different cross-sectional shapes on the carburetor connection flange 32 and on the engine connection flange 33. This enables a good connection geometry to be achieved. Owing to the different cross-sectional shapes, vortices which arise can be largely prevented by the guiding rib 39.

Figure 16:
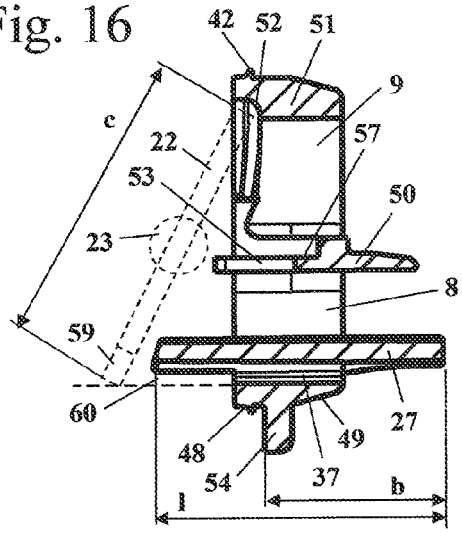
FIG. 16 shows a section along the line XVI-XVI in FIG. 15.
Figure 17:
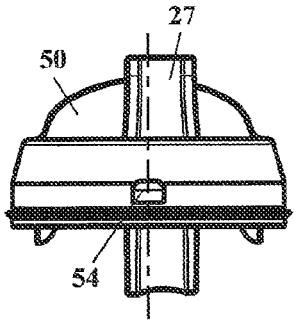
FIG. 17 shows a side view in the direction of the arrow XVII in FIG. 15.

FIGS. 14 to 17 show in detail the configuration of a preferred embodiment of the intermediate ring 36. The intermediate ring 36 has an outwardly protruding positioning lug 54 which is arranged in the receptacle 56 of the connecting stub 28 (FIG. 5). As the figures show, the shielding element 27 is of curved design, wherein the concave side bounds the secondary passage 37. On the side opposite the shielding element 27, the secondary passage 37 is bounded by the outer wall 73 (FIG. 7) of the mixture passage 8. This results in a very small flow cross section of the secondary passage 37. The secondary passage 37 is separated from the mixture passage 8 only by the shielding element 27 integrally formed on the intermediate ring 36. The shielding element 27 projects on both sides beyond the annular section of the intermediate ring 36 and projects into the carburetor 17 and the connecting stub 28. As the figures show, a separating wall section 50 is integrally formed on the intermediate ring 36. As FIG. 16 shows, a bearing surface 57 for the throttle valve 22 is formed on the separating wall section 50. On the section protruding into the connecting stub 28, the separating wall section 50 is of flattened design, and therefore the flattened portion of the separating wall section 50 bears against the separating wall section 74 (FIG. 7) in the connecting stub 28 and thus leads to an increase in stability.

On the side bordering the air passage 9, the intermediate ring 36 has a thickened portion 51. As shown schematically in FIG. 16, when the throttle valve 22 is slightly open, for example, during idling, a gap is formed between the edge of the throttle valve 22 and the intermediate ring 36, through which gap the combustion air flows. That side of the thickened portion 51 which faces the throttle valve 22 is formed in a radius 52, and therefore the air flowing past between the throttle valve 22 and the intermediate ring 26 is directed toward the mixture passage 8. In the process, the combustion air flows through the opening 53 formed between the throttle valve 22 and the separating wall section 50.

As FIG. 16 shows, the intermediate ring 36 has a first fastening section 48 which protrudes into the carburetor 17 and bears an outwardly protruding web or protrusion lip 42, with which the fastening section 48 is held in a sealing manner in the carburetor 17. The web 42 is provided to compensate for tolerances and is deformed or sheared off during fitting such that the fastening section 48 always sits in a sealing manner in the carburetor 17 even in the event of unfavorable tolerance pairings. The second fastening section 49, which lies downstream and protrudes into the connecting stub 28, is of partially conically tapering design, and therefore the connecting stub 28 can be pushed in a readily sealing manner onto the intermediate ring 36.

As FIG. 16 shows, the intermediate ring 36 has an insertion length *b* into the connecting stub 28, which length approximately corresponds to the distance *a* (FIG. 6) of the carburetor-side end 46 of the guiding rib 39. The shielding element 27, and therefore the secondary passage 37, has a length *l* which is approximately 25% to approximately 150% of the diameter *c* of the throttle valve 22. A length l of the secondary passage 37 of approximately 40% to approximately 100% of the diameter *c* of the throttle valve 22 is considered to be particularly advantageous. FIG. 16 also shows the entry opening 60 into the secondary passage 37 at the upstream end of the secondary passage 37. In the idling position of the throttle valve 22 that is shown in FIG. 16, the throttle valve 22 is adjacent to the entry opening 60. In this case, the opening 59 in throttle valve 22 is arranged on the entry opening 60, and therefore combustion air can flow into the secondary passage 37 through the opening 59.

Figure 18:
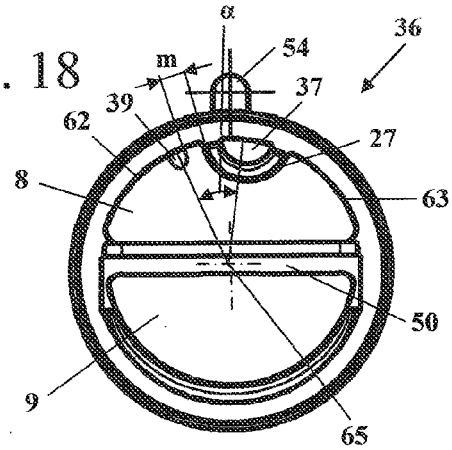
FIG. 18 shows a schematic side view of the intermediate ring from the side facing the carburetor.

FIG. 18 shows the intermediate ring 36 and the guiding rib 39 in an installed position looking from the carburetor 17.

The mixture passage 8 is arranged above the air passage 9 in the direction of gravitational force. In the connecting stub 28, the guiding rib 39, which is shown schematically in FIG. 18 in order to clarify the arrangement, is offset laterally in the circumferential direction with respect to the secondary passage 37. The guiding rib 39 encloses an angle $\alpha$ with the secondary passage 37, which is sufficient to ensure that fuel flows along only one side of the guiding rib. This angle is advantageously from approximately 10° to approximately 45°. In this case, the angle $\alpha$ is measured between the connecting line extending from the center of the secondary passage 37 and the connecting line at the center of the guiding rib 39, in each case the lines connecting to the longitudinal axis 65 of the intake passage. As FIG. 18 also schematically shows, the circumferential wall section 63, into which the secondary passage 37 opens, is significantly smaller than the circumferential wall section 62. The flow guiding rib 39 does not directly adjoin the shielding element 27, as seen in the direction of flow 58. A distance m is preferably formed between the shielding element 27 and the flow guiding rib 39. The distance here can be small and can be considerably less than the width of the secondary passage.

The invention claimed is:

1. A two-stroke engine, comprising: a crankcase; a cylinder connected to said crankcase; a piston reciprocally mounted within said cylinder to define a combustion chamber in said cylinder; a crankshaft mounted rotatably in said crankcase and drivingly connected with said piston; at least one overflow passage connecting the crankcase and the combustion chamber when the piston is located in the region of its lower dead center position; a connecting stub attached to said cylinder and having therein an intake passage that opens into the crankcase and supplies fuel and combustion air, said intake passage including therein an air-fuel mixture passage, wherein at least one section of the mixture passage extends in said connecting stub; at least one fuel opening for supplying fuel into said mixture passage; and a guiding rib positioned within said connecting stub and running in the longitudinal direction of the mixture passage and protruding into the mixture passage.

2. A two-stroke engine according to claim 1, wherein the height of the guiding rib is approximately 5% to approximately 25% of the diameter of the intake passage at the upstream end of the connecting stub.

3. A two-stroke engine according to claim 1, wherein said at least one fuel opening comprises at least one idling fuel opening, and further comprising an elongated element positioned in said mixture passage to form a secondary passage in the mixture passage, into which the at least one idling fuel opening opens, the secondary passage opening into the mixture passage at a radial position offset with respect to the guiding rib by an angle about the longitudinal axis of the intake passage, with reference to the direction of flow in the connecting stub.

4. A two-stroke engine according to claim 3, wherein the guiding rib begins at a distance from the upstream end of the connecting stub, which distance is approximately the same as the distance by which the secondary passage extends into the connecting stub.

5. A two-stroke engine according to claim 1, further comprising a carburetor, and wherein a section of the intake passage is formed in said carburetor, wherein the intake passage includes a divider positioned therein downstream of the carburetor, dividing the intake passage into an air passage and said mixture passage, wherein said at least one fuel opening is located in the carburetor, and wherein said carburetor further comprises a throttle valve being mounted pivotably therein, for controlling the combustion air quantity supplied to the air passage and to the mixture passage.

6. A two-stroke engine according to claim 5, further comprising within the connecting stub a separating wall separating the air passage and the mixture passage from one another, and wherein the guiding rib is positioned on the radially outer, inside wall surface of the mixture passage and is arranged opposite said separating wall to divide said wall surface into a first circumferential section and a second circumferential section.

7. A two-stroke engine according to claim 5, wherein the connecting stub further comprises a plurality of pyramid-shaped elevations in the mixture passage and in the air passage.

8. A two-stroke engine according to claim 7, wherein the elevations are offset with respect to one another in such a manner that intersecting passages which are inclined with respect to the longitudinal axis of the intake passage are formed between the elevations.

9. A two-stroke engine according to claim 7, wherein said elevations in the connecting stub are arranged on the outer, inside wall surface of the air passage, on the outer, inside wall surface of the mixture passage and on both sides of the separating wall.

10. A two-stroke engine according to claim 7, wherein the elevations in the air passage extend over less than half of the length of that section of the air passage which is within the connecting stub, and in that the elevations in the mixture passage extend over less than half of the length of that section of the mixture passage which is within the connecting stub.

11. A two-stroke engine according to claim 7, wherein the elevations are arranged in a central region of the connecting stub with reference to the length of the connecting stub.

12. A two-stroke engine according to claim 7, wherein the elevations in the air passage and the elevations in the mixture passage are arranged axially offset with respect to one another in the direction of flow.

13. A two-stroke engine according to claim 1, wherein the mixture passage has different cross-sectional shapes at the upstream end and at the downstream end of the connecting stub.

* * * * *